US007185513B2

(12) United States Patent
Bush et al.

(10) Patent No.: US 7,185,513 B2
(45) Date of Patent: Mar. 6, 2007

(54) LOW PROFILE EVAPORATOR COIL

(75) Inventors: Joseph P. Bush, Lawrenceville, GA (US); John L. Bauer, Jr., Grenada, MS (US); Christopher D. Beck, Grenada, MS (US)

(73) Assignee: Advanced Distributor Products LLC, Grenada, MI (US)

( * ) Notice: Subject to any disclaimer, the term of this patent is extended or adjusted under 35 U.S.C. 154(b) by 125 days.

(21) Appl. No.: 11/065,955

(22) Filed: Feb. 25, 2005

(65) Prior Publication Data

US 2006/0191289 A1 Aug. 31, 2006

(51) Int. Cl.
*F25B 39/02* (2006.01)

(52) U.S. Cl. ..... 62/515; 62/476

(58) Field of Classification Search ..... None
See application file for complete search history.

(56) References Cited

U.S. PATENT DOCUMENTS

| | | | | |
|---|---|---|---|---|
| 2,959,031 A | | 11/1960 | Hopkinson et al. | |
| 3,831,670 A | * | 8/1974 | Mullings | 165/124 |
| 4,000,779 A | * | 1/1977 | Irwin | 165/111 |
| 5,121,613 A | | 6/1992 | Cox et al. | |
| 5,207,074 A | | 5/1993 | Cox et al. | |
| 5,284,027 A | | 2/1994 | Martin, Sr. | |

* cited by examiner

*Primary Examiner*—Melvin Jones
(74) *Attorney, Agent, or Firm*—Brooks Kushman P.C.

(57) ABSTRACT

A low profile evaporator coil assembly and method for configuring the assembly in HVAC equipment. In one deployment, the assembly 40 is located between a heating furnace and a plenum. The assembly 40 includes multiple coil slabs 42 through which a refrigerant courses. The slabs 42 lie in a parallel relationship at an angle of inclination to the air entering a coil assembly 40. A baffle 46 is associated with each coil slab 42 to constrain air flow through the associated coil slab. A drain pan 52 is positioned beneath the slabs. The drain pan 52 has multiple troughs 54 for collecting condensate. At least some of the multiple troughs 54 have an air foil 56 that reduces air flow restriction.

12 Claims, 5 Drawing Sheets

Fig 6
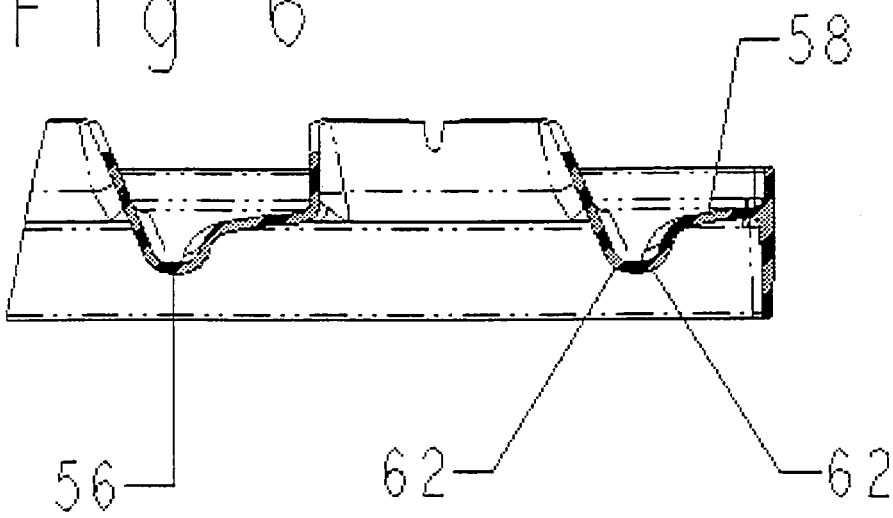
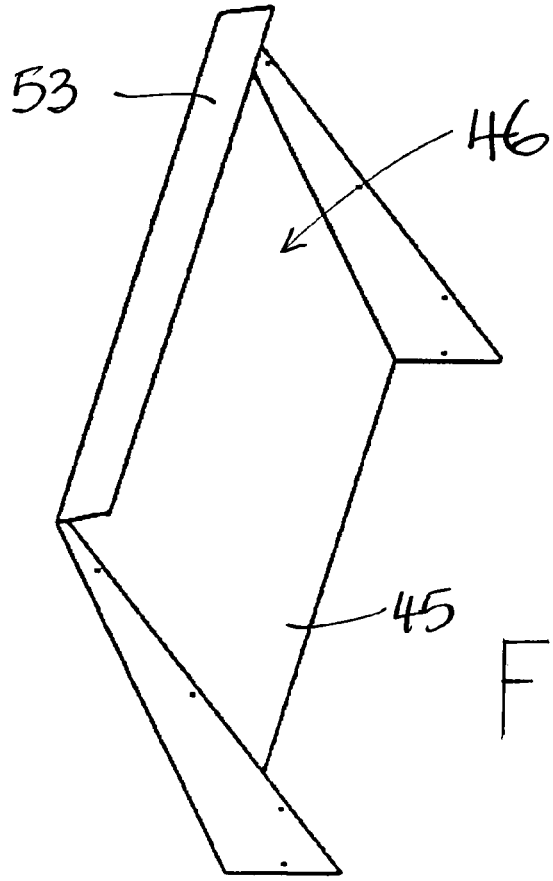
Fig 7

LOW PROFILE EVAPORATOR COIL

BACKGROUND OF THE INVENTION

1. Field of the Invention

This invention relates to air conditioning coils that are associated with the discharge side of a heating furnace.

2. Background Art

Conventionally, the conditioning of air ("air conditioning") includes not only its cooling but also the heating of air, cleaning it and controlling its moisture level. Air conditioning typically occurs in heating, ventilation, and air conditioning (HVAC) equipment.

The Department of Energy (DOE) has imposed minimum efficiency requirements for residential-light commercial HVAC equipment. In response to standards derived from the National Appliance Energy Conservation Act (NAECA) and to meet the challenges imposed by the federally-mandated standards, manufacturers seek ways to produce more efficient equipment, while making that equipment available to the consumer or user at an affordable pricing structure. One consideration is the consumer's life cycle cost for equipment that operates at various efficiency levels. At issue, for example, is whether a high-efficiency system can be justified to home owners in northern states and whether such systems would operate long enough to offer a reasonable payback.

To accomplish air conditioning tasks, conventional air conditioning systems include five components: (1) a compressor; (2) a fan; (3) a condenser coil (hot); (4) an evaporator coil (cool); and (5) a chemical refrigerant. In a conventional air conditioner, a refrigerant like liquid ammonia or Freon® is the coolant. As used herein, the term "Freon®" is generically used for any of various non-flammable fluorocarbons used as refrigerants.

It is generally understood that the efficiency of an air conditioning system can be raised by adding to the face area of a coil. But historically, expanding the face area of the coil has produced coils that are too large to meet the spatial constraints imposed by the environment of use. Typically, coils are accommodated by housings that are tailored to satisfy industry or residential needs. Often, the space allocated in a building to the installation of a housing with coil therein is a relatively small space that is limited by walls and ceilings. One consequence is that enlarged coils (sized for efficiency) cannot be accommodated.

Another factor to be considered in designing efficient HVAC equipment is coil orientation, which may also be limited by the shape of drain pans that are needed to collect condensate.

There has thus arisen a requirement for coils with expanded face areas for air conditioning systems that can usefully be deployed in existing housings and installation sites, that are not limited to a single orientation. Additionally, there is a continued desire for suitable drain pans that can serve coils which may be deployed in various orientations.

Furthermore, it is desirable that such systems be simple to install and readily fabricated, while not being too difficult to access for repair and maintenance.

The following U.S. references were identified in a preliminary search that preceded the filing of this application: U.S. Pat. Nos. 2,959,031; 5,121,613; 5,207,074; and 5,284,027.

SUMMARY OF THE INVENTION

To meet these among other needs, the invention includes a low profile evaporator coil assembly which is used in HVAC systems. The assembly is typically located proximal to a discharge side of a furnace or an air handler (on the inlet side) and upstream of a plenum.

The assembly includes multiple coil slabs or heat exchangers. Each slab has segments that define internal passages through which a refrigerant courses. Preferably, the slabs are deployed in a parallel relationship at an angle of inclination to the direction of a major component of air entering the multiple coil slabs.

A baffle is associated with each coil slab. Each baffle directs air through an associated coil slab. The baffle is positioned around the slab's opposed ends. It constrains and redirects air flow through the associated coil slab.

Preferably, the low profile evaporator coil assembly also includes a drain pan that is positioned beneath the multiple coil slabs. The drain pan has a trough beneath each coil slab and an air foil on an outer contour that reduces air flow restriction by directing air in a divergent pattern toward adjacent coil slabs. The trough also has an inner contour that defines a shelf which supports the coil slab.

In a preferred embodiment, the trough has a lowermost portion that is provided with a radiused section that localizes drainage.

Also, in a preferred embodiment, the multiple coil slabs may include between 3 and 5 coil slabs and the angle of inclination will depend on coil height and pan width.

BRIEF DESCRIPTION OF THE DRAWINGS

FIG. 6 is a front end sectional view of a portion of the embodiment depicted in FIG. 4; and FIG. 7 is a quartering perspective view of a baffle.

DETAILED DESCRIPTION OF THE PREFERRED EMBODIMENT(S)

Figure 1:
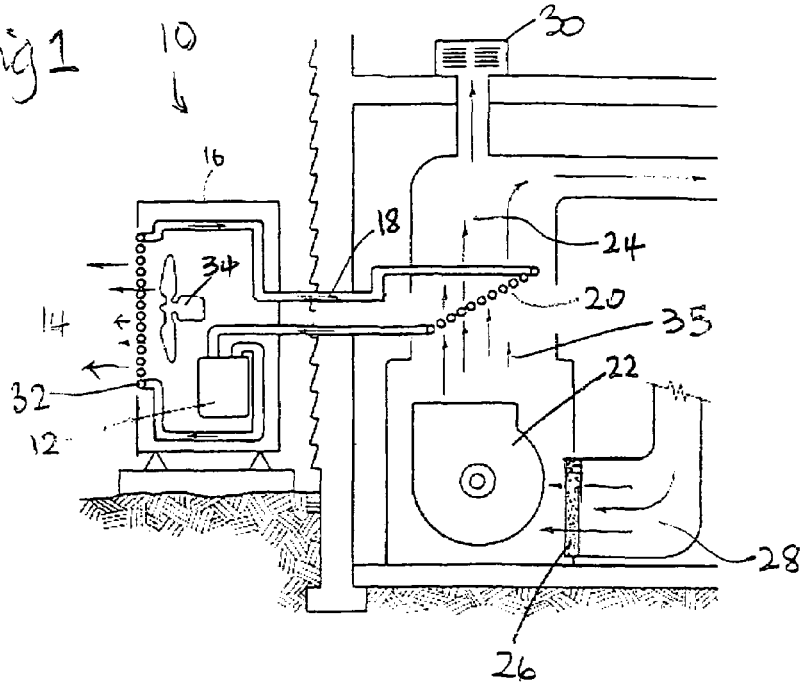
FIG. 1 illustrates a heating, ventilation and air conditioning (HVAC) environment in which the invention is deployed.

FIG. 1 illustrates one environment in which the invention may be situated. In conventional terms, an air conditioning (HVAC) system 10 cools and heats air, cleans it and controls its moisture level to provide a desirable indoor environment. Conventionally, an HVAC system takes thermal energy (heat) from the inside of an enclosure, such as a building and transfers it to a location outside the building. In FIG. 1, the reference numeral 28 symbolizes warm return air that passes through a filter 26, which performs the cleaning function of an HVAC system by removing dust from the air. Refrigerant flowing through tubing 18 in the HVAC system absorbs the thermal energy from the warm return air that is expelled by a furnace 22. The refrigerant is pumped by a compressor 12 through the closed system of pipes 18 to an outside coil 32. A fan 34 blows outside air over the hot coil 32 and transfers heat from the refrigerant to the outdoor air. The indoor enclosure is cooled because heat is removed from the indoor air.

In FIG. 1, in an air conditioning mode, the "hot" side of an HVAC system is typically positioned outside a building. The "cold" side is located inside the building. Conventionally, the "hot" side includes the condensing coil 32, the compressor 12 and the fan 34. The "cold" side is typically located inside the building or other structure. Furnace air 35 blows through an evaporator coil 20. This coil cools the air. The cooled air is then distributed throughout the building or home through a series of ducts. In some applications, in a heat pump system, the previous description is reversed.

Figure 2:
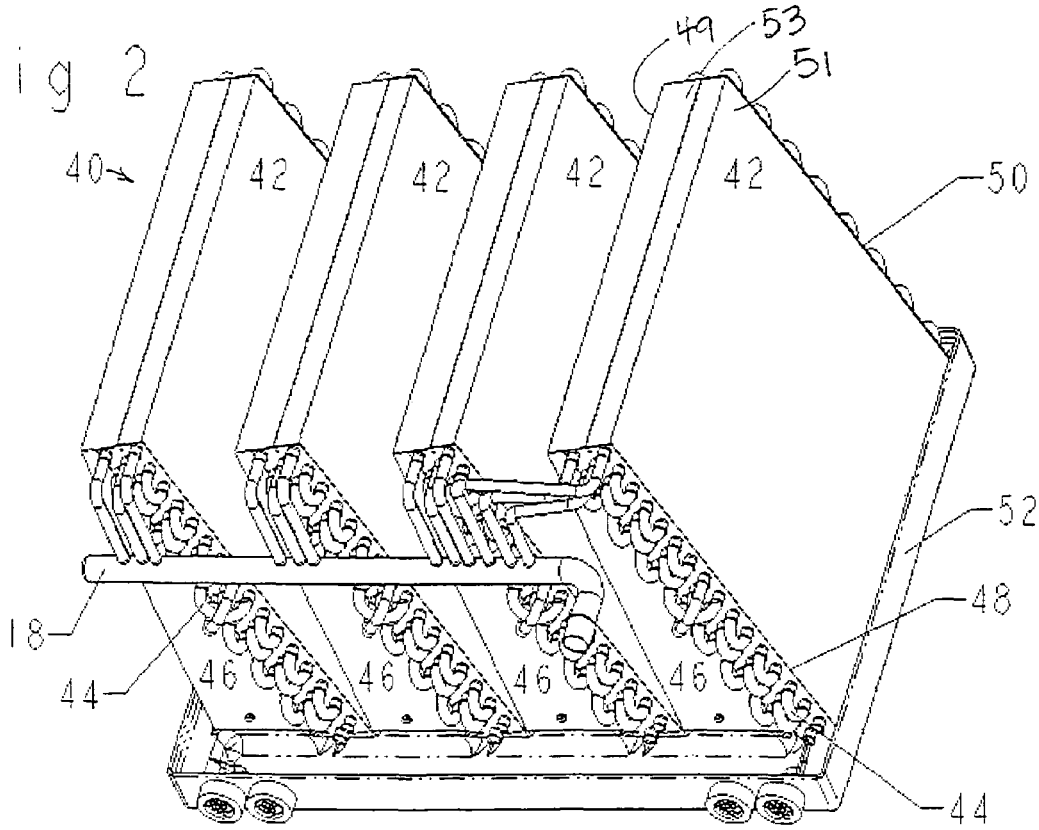
FIG. 2 is a quartering perspective view of a low profile evaporator coil having multiple coil slabs constructed according to the invention.

FIG. 2 illustrates a low profile evaporator coil assembly 40 that is used as an evaporator coil such as that represented by the reference numeral 20 in FIG. 1. Assembly 40 is located proximal to the discharge side of a heating furnace 22 (FIG. 1), and upstream of a plenum 30.

As illustrated in the embodiment of FIG. 2, the assembly 40 includes multiple coil slabs 42. In the embodiment depicted, there are four coil slabs. Each coil slab 42 has coil segments 44 that define internal passages therewithin. A refrigerant courses through the internal passages. As illustrated, the multiple coil slabs 42 preferably are deployed in a parallel relationship. They (line A—A) have an angle of inclination (alpha) (FIG. 3) to the direction (B—B) of a major component of air entering the multiple coil slabs 40 or one face 45 of the baffles.

FIGS. 2 & 7 also illustrate a baffle 46 that is associated with each coil slab 42 of the coil assembly 40. Each baffle 46 has a side face 45 (FIG. 3) that terminates in a roof portion 53. The baffles 46 direct air to a corresponding one of the multiple coil slabs 42. As illustrated, each baffle 46 is positioned around the opposed ends 48,50 of the associated coil slab 42. The baffle constrains air flow through the associated coil slab.

Figure 4:
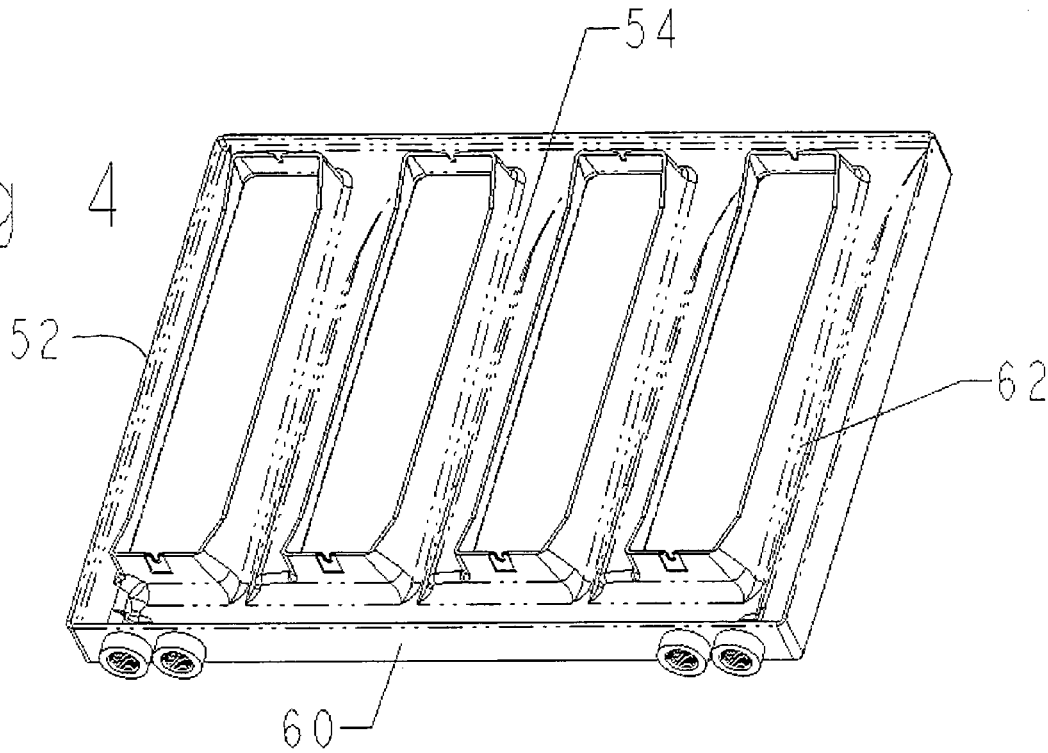
FIG. 4 is a quartering perspective view of a drain pan that is positioned to receive the multiple coil slabs depicted in FIG. 2.
Figure 5:
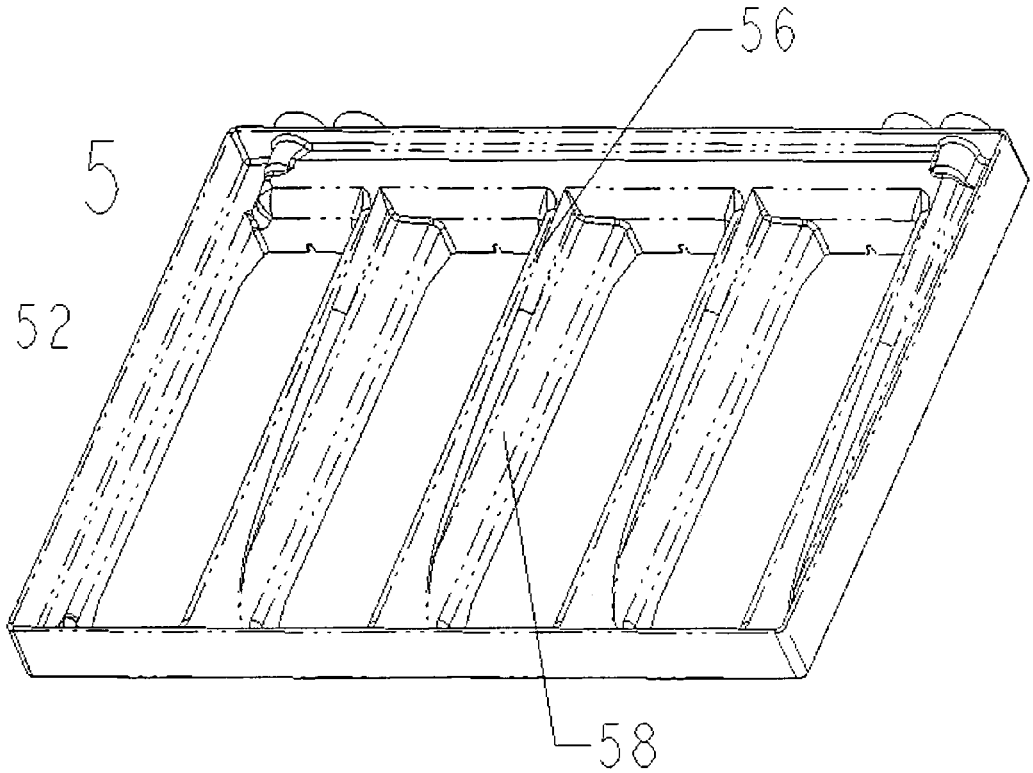
FIG. 5 is a quartering perspective view of the underside of the drain pan shown in FIG. 4.

FIGS. 4–6 illustrate one embodiment of a drain pan 52 that lies below the multiple coil assembly 40. FIG. 4 illustrates the drain pan 52 in a position in which it is oriented to receive the multiple coil assembly 40, while FIG. 5 illustrates the underside of the drain pan 52 shown in FIG. 4.

As best shown in FIGS. 4–6, a trough 54, defined by a drain pan 52 lies beneath each coil slab 42 for collecting condensate. The troughs 54 inside the drain pan 52 are sloped so that condensate tends to flow toward a forward side 60 thereof. To enhance drainage, the drain pan 52 is provided with a portion that includes a radiused section 62 (FIG. 6) to enhance drainage.

thereof. To enhance drainage, the drain pan 52 is provided with a portion that includes a radiused section 62 (FIG. 6) to enhance drainage.

As shown in FIGS. 5 and 6, associated with the multiple troughs 54 are air foils 56 that reduce air flow restriction by directing air in a divergent pattern toward adjacent coil slabs 42. An inner contour of each trough defines a shelf 58 for supporting the multiple coil slabs 42.

Figure 3:
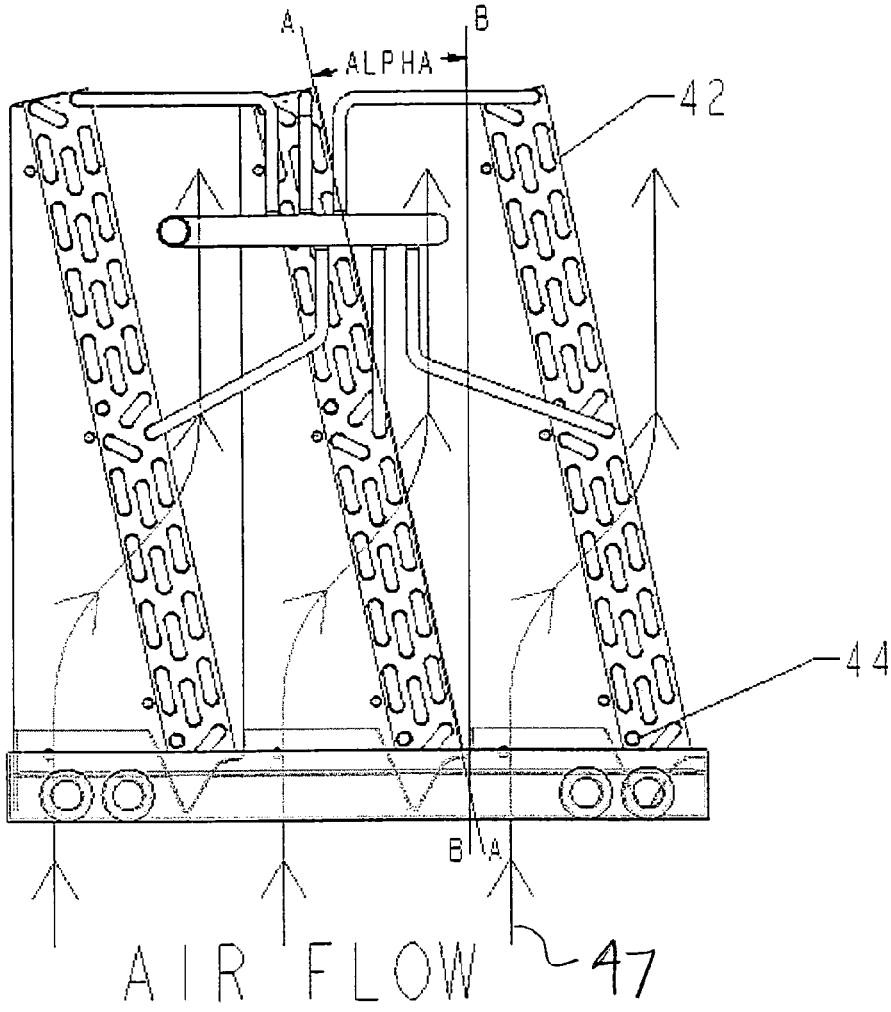
FIG. 3 is an end view of one embodiment of the invention, in which there are three coil slabs.

In a preferred embodiment (see, e.g., FIG. 3), the coil assembly 40 has three coil slabs 42. FIG. 3 also illustrates a major component 47 of the air flowing among the slabs 42 of the coil assembly 40.

In light of the previous description, it will be appreciated that the invention includes coordinating the number of coil slabs, the coil angle alpha, the baffle profile 46 and the drain pan configuration 52 for optimal air flow performance.

The table below includes data that emerged from experiments which observed the static pressure drop through the coils (measured in inches of water) produced by various sizes of coil assembly and air flow (measured in cubic feet per minute). (For reference, a one-ton HVAC system can handle about 400 cubic feet of air per minute.)

| | | | Air Flow (CFM) Static Pressure (in. of water) | | | |
|---|---|---|---|---|---|---|
| Slab Size (1) | No. Slabs (2) | Drain Pan Width (3) | 0.2 (4) | 0.3 (5) | 0.37 (6) | 0.4 (7) |
| 20 × 16 | 4 | 20.5 | 1361 | 1713 | | 2007 |
| 20 × 16 | 3 | 20.5 | 1589 | 1936 | | |
| 18 × 16 | 3 | 13 | 774 | 933 | | 1089 |
| 16 × 16 | 4 | 24 | 1423 | 1826 | | 2137 |

In the above table, column 1 represents the size (height× depth) of various slab assemblies. Column 2 represents the number of slabs in each assembly. Column 3 represents the width of the drain pan. Subsequent columns indicate the volume of air flow (CFM) and static pressure drop (inches of water) therein from 0.2–0.4 inches.

Consider column (5). It portrays air flow (CFM) observed under 0.3 inches of a typical maximum static design pressure drop for the four conditions. In one case, for example, 1936 CFM passed through a coil assembly with three slabs each measuring 20×16 inches. In that case, the drain pan was about 20.5 inches in width.

When the slab size is small (e.g., 18×16 inches), the observed width of the drain pan in our example was 13 inches. Other dimensions (e.g., 13, 14, 15½, 17, 20½, or 24 inches) are contemplated. When there are 0.3 inches of static pressure drop, 933 cubic feet per minute of air (about 2.5 tons) pass through the coil assembly.

Thus there has been disclosed a low profile evaporator design that allows a greater amount of coil surface area to be installed within a given space. This allows the use of properly matched coil to a tall enough plenum for good air distribution. Thus, as the minimum SEER requirements increase, the invention satisfies an increasing demand for higher capacity coils without increasing height.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low profile evaporator coil assembly for use in heating, ventilation and air conditioning equipment, the assembly being located proximal to a discharge side of a heating furnace or the inlet side of an air handler and upstream of a plenum, the assembly comprising:

multiple coil slabs, each slab having coil segments that define an internal passage therewithin, said passage being adapted for a refrigerant flow therethrough, the multiple coil slabs having an angle of inclination to a major component of air entering the multiple coil slabs; and a baffle associated with each coil slab of the multiple coil slabs for directing air through a corresponding one of the multiple coil slabs, the baffle associated with each coil slab being positioned around opposed ends of the corresponding one of the multiple coil slabs, the baffle associated with each coil slab being configured to direct substantially all of the air that contacts the baffle through the corresponding one of the multiple coil slabs.

2. The low profile evaporator coil assembly of claim 1, further including a drain pan positioned beneath the multiple coil slabs, the drain pan having multiple troughs for collecting condensate, at least one of the multiple troughs having an airfoil to reduce airflow restriction by directing at least some air in a divergent pattern toward adjacent coil slabs and a shelf for supporting one of the coil slabs.

3. The low profile evaporator coil assembly of claim 2, wherein the drain pan has a radiused section to localize drainage.

4. The low profile evaporator coil assembly of claim 1, wherein the coil assembly has between 3–5 coil slabs and the angle of inclination is a function of drain pan width and coil slab height.

5. The low profile evaporator coil assembly of claim 1, wherein the multiple coil slabs comprise 3 coil slabs and the angle of inclination is about 11 degrees.

6. The low profile evaporator coil assembly of claim 1, wherein the multiple coil slabs are deployed in a parallel relationship.

7. The low profile evaporator coil assembly of claim 1, wherein each baffle has a face, a pair of opposing end faces and a roof portion.

8. The low profile evaporator coil assembly of claim 2, wherein said at least one of the multiple troughs has an outer contour on which the air foil is located that faces incoming air.

9. The low profile evaporator coil assembly of claim 2, wherein said at least one of the multiple troughs has an inner contour on which the shelf is defined.

10. The low profile evaporator coil assembly of claim 2, wherein the multiple troughs in the drain pan are sloped forwardly so that condensate flows along the multiple troughs toward a front portion of the drain pan.

11. The low profile evaporator coil assembly of claim 9, wherein the drain pan is provided with drain openings located at the front thereof in order to direct condensate flow.

12. A method for configuring an evaporator coil so that its performance characteristics meet or exceed minimum SEER requirements and yet can be accommodated within spatial constraints, the method comprising the steps of:

deploying a multiple slab coil assembly through which a refrigerant is able to course, each slab in the multiple slab coil assembly having an angle of inclination to the air entering the multiple slab coil assembly;

mounting a baffle around each slab coil, each baffle being configured to constrain air contacting the baffle to flow only through an associated coil slab; and locating a drain pan beneath the multiple coil slab assembly, the drain pan being provided with multiple troughs for collecting condensate and with an air foil that reduces air flow restriction by directing incoming air in a divergent pattern toward adjacent slabs.

* * * * *